United States Patent [19]

Pasquier

[11] Patent Number: 4,538,369

[45] Date of Patent: Sep. 3, 1985

[54] SNOW TRANSFER INSTALLATION

[75] Inventor: Armand Pasquier, Annecy, France

[73] Assignee: Etudes Techniques et Realisations (CdF Ingenierie) S.A., France

[21] Appl. No.: 533,592

[22] Filed: Sep. 19, 1983

[30] Foreign Application Priority Data

Sep. 17, 1982 [FR] France ..... 82 15687

[51] Int. Cl.[3] ..... E01H 8/04

[52] U.S. Cl. ..... 37/219; 239/25

[58] Field of Search ..... 37/219, 221, 232, 197, 37/196; 239/25

[56] References Cited

U.S. PATENT DOCUMENTS

| | | | |
|---|---|---|---|
| 1,468,977 | 9/1923 | Schiesari | 37/197 |
| 2,676,471 | 4/1959 | Pierce . | |
| 3,257,815 | 6/1966 | Brocoff et al. . | |
| 3,706,414 | 12/1972 | Dupre . | |
| 4,050,169 | 9/1977 | Pasquier | 37/219 X |
| 4,249,322 | 2/1981 | McLaughlin | 37/196 |
| 4,404,762 | 9/1983 | Munsterer . | |

FOREIGN PATENT DOCUMENTS

| | | |
|---|---|---|
| 2289414 | 7/1976 | France . |
| 2327172 | 5/1977 | France . |

*Primary Examiner*—E. H. Eickholt

*Attorney, Agent, or Firm*—Finnegan, Henderson, Farabow, Garrett & Dunner

[57] ABSTRACT

A snow transfer installation, including at least one element for snow pickup associated with an element for the production of a mixture of snow and air, the said pickup and mixture production being mounted on a vehicle, a transportation duct for the snow-air mixture and an air flow generator. The air flow generator is independent of the pickup and mixture production elements and is connected to the mixture production element by means of a duct, at least a portion of which is flexible.

9 Claims, 7 Drawing Figures

FIG. 3a.
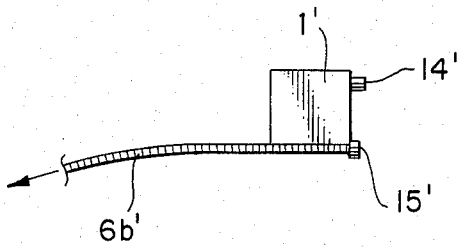
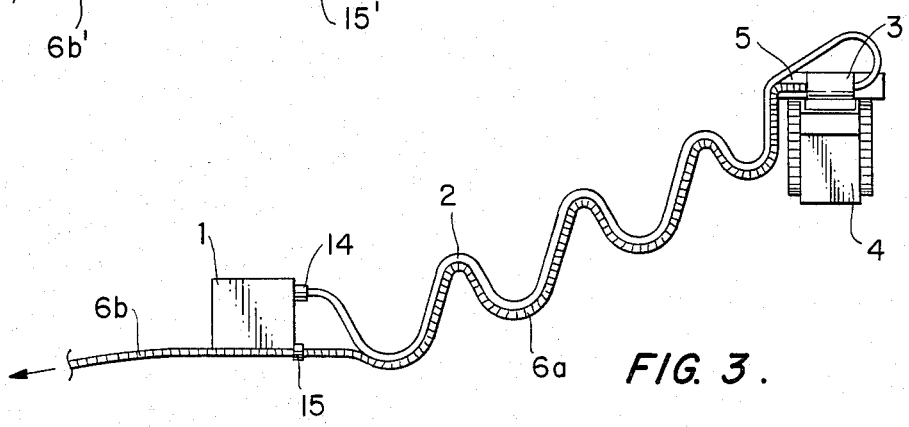
FIG. 3.
FIG. 4.
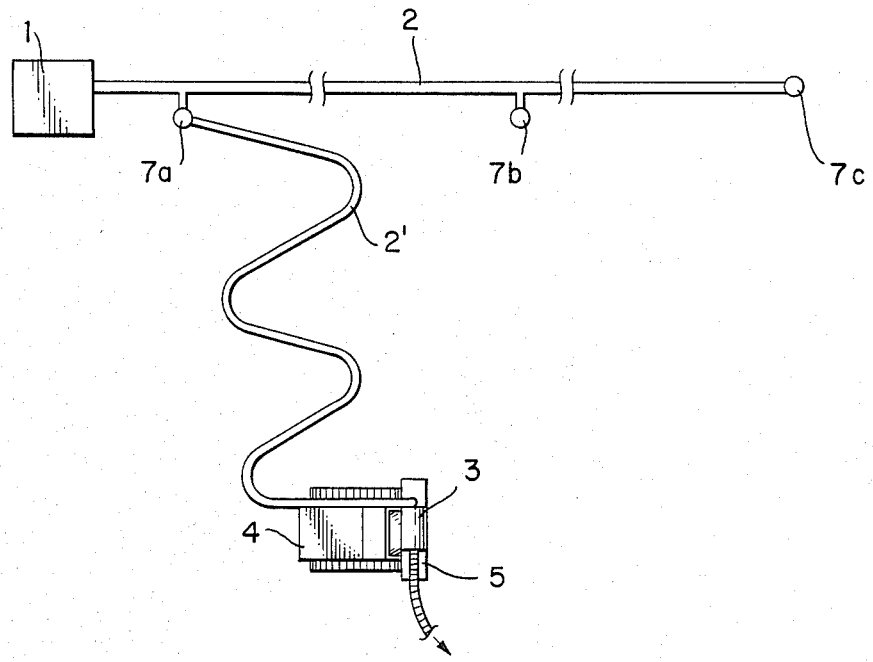

SNOW TRANSFER INSTALLATION

BACKGROUND OF THE INVENTION

1. Field of the Invention

The present invention concerns a snow-transfer installation. More particularly, it concerns an installation intended to carry out snow removal operations, including evacuating the snow from locations where it constitutes a problem to a discharge point which can be either a ski slope, wherein an operation of snow deposition can be carried out in parallel, or an unused area.

2. Background of the Invention

It is known from French Pat. Nos. 2,289,414 and 2,327,172 to deposit snow on ski slopes by taking snow away from an accumulation and transporting it pneumatically towards the utilization point by means of a duct. The apparatus described in these patents comprises a fan delivering air into a transport duct on which a snow injector and at least one connection for a projection tube are mounted. The installation associated with the transport duct can be fixed, the snow pickup element, the injector and the air flow generator being permanently placed at their utilization position. The installation can likewise be mobile and comprise the same elements mounted on a vehicle.

To carry out the snow removal operations, the fixed installation is only utilizable in places where accumulations of snow are found. Furthermore, the mobile installation has several faults, chiefly excessive weight, necessitating the use of overdimensioned transportation vehicles. The snow removal operations using such a mobile installation have a high sound level, and can be particularly annoying when such operations are performed at night near dwellings.

SUMMARY OF THE INVENTION

The above defects are remedied by means of the installation according to the present invention, the advantages of which will become apparent on reading the following description.

In accordance with the present invention the installation for snow transfer comprises at least one snow pickup element associated with an element for producing a mixture of snow and air, the said pickup and mixture production elements being mounted on a vehicle, a duct for transportation of the mixture of snow and air, an air flow generator, characterized in that the air flow generator is independent of the pickup and mixture production elements and is connected to the element for production of the mixture by means of a duct at least one portion of which is flexible.

Thus, according to the present invention the air flow generator is not mounted on the vehicle carrying the snow pickup element and the air-snow mixture producing element; it is independent of the said vehicle and can be positioned at a chosen location during the period of the operations, without having to permanently accompany the unit constituted by the pickup element and the production element. The air flow generator can constitute a fixed unit, permanently located without having to be moved. Thus it can be installed at the edge of a ski slope, a path, a road, or even in a building. It comprises a fan and an energy source (self-contained heat engine or electric motor) delivering power to the fan. The air flow generator can likewise constitute a mobile unit, independent of the vehicle carrying the pickup and production elements; the motor is then of the thermal type. This mobile unit can be carried on the platform of a tracked vehicle, or simply carried by a sled which is tractor-drawn by means of a machine which is attached for the operation of positioning. During the operation of the installation, the mobile unit comprising the air generator is generally static.

The air flow generator is connected to the production element for the snow-air mixture by means of a duct, at least one portion of which is flexible. Advantageously the whole of the duct is flexible, so as to permit the displacement of the vehicle carrying the pickup and production elements with respect to the air flow generator, which is static, over the greatest possible distance which is compatible with the correct operation of the installation. A duct length on the order of 50 meters would permit the installation to have an outstanding productivity. Of course, all precautions are taken to prevent the duct from being crushed by the carrying vehicle. The duct can, for example, be coiled behind the said vehicle.

The snow pickup element is, for example, a cutter of the type described in French Pat. No. 2,289,414. The production element for the snow-air mixture is, for example, an injector (rotary gate) such as described in the same patent. The cutter is driven either by a hydraulic motor itself driven by a pump integral with the carrying vehicle, or by a mechanical power takeoff such as is found on agricultural tractors. The injector is, for example, driven by a hydraulic motor, the pump of which can be driven by any motion source.

The pickup and production elements are positioned on a carrying vehicle such as a tracked vehicle or a motor tractor.

The snow, picked up by the cutter, is admitted into the injector, into which there is likewise admitted air derived from the air flow generator via the duct provided for this purpose. The mixture of snow and air thus formed is admitted into a duct, through which it passes and at the end of which snow is evacuated either to an unused area or towards a ski slope which is to have snow deposited on it. (In the latter case, the end of the duct is advantageously equipped with an ejection nozzle). Note that two ducts are connected to the production element carried by the vehicle: the duct for air derived from the air generator and the transport duct for the snow-air mixture. The air duct generally has a diameter smaller than that of the transport duct. This transport duct is advantageously flexible over at least a fraction of its length. It is thus possible to make this flexible fraction integral with the flexible portion of the duct connecting the air flow generator and the production element. This particular embodiment greatly facilitates operations, since only one duct assembly is to be manipulated instead of two separate ducts. The length of the transportation duct is optional, and is essentially a function of the distance which separates the carrying vehicle from the place where the snow is to be evacuated. A particular embodiment of the installation consists of utilizing an assembly of ducts having the same length and air flow generator unit with which is associated the end of another portion of transportation duct. Note, then, that a carrying vehicle can thus be connected by means of an air duct which is integral with it to an air flow generator, and by means of a transportation duct which is likewise integral with it to the end of the other portion of transportation duct associated with the said air flow generator. Advantageously, the two ducts which are integral with the vehicle are also mutually integral. A carrying vehicle can then remove snow from snow locations situated nearby to an air flow generator, which for example is static, and then move with its assembly of air and transport ducts to another generator, near which it will operate after the connections have been made between the air duct and the generator on the one hand and between its transportation duct, on the other hand, and the portion of transport duct associated with the air flow generator. This particular embodiment makes possible great autonomy, avoids displacement and vehicular transportation of great lengths of ducting, and gives the utilization of the installation very great flexibility.

In order to simplify the particular embodiment described above (which nevertheless requires several air flow generator units so as to remove snow from widely-separated locations), the installation can be such that the duct connecting the air flow generator to the production element is partially fixed to the ground, for example anchored by any known method in deep layers of snow. In this case, the part of the air duct fixed to the ground can be of a rigid material. According to this particular embodiment, it is then possible to supply with air a production element situated at a considerable distance from the air flow generator without having to manipulate long lengths of ducting.

The transportation duct can likewise be fixed to the ground and be partially rigid.

According to another particular embodiment of the invention, a duct fixed to the ground can, by means of arrangements described below, carry air for a portion of its length and a snow-air mixture for the other portion of its length. This particular operation is possible by providing the said rigid duct with connections enabling it to be connected to a flexible air duct on the one hand and to a flexible transportation duct on the other hand, the ends of which ducts are connected, respectively, upstream and downstream of the production element. This rigid duct can be equipped with valves, and the different connections are equipped with obturators when out of action.

Advantageously, the connections are equipped with shutters which can be folded back and which permit, or do not permit, compressed air to be injected and the snow-air mixture to be collected, by means of the said connections. Advantageously, the said connections are coupled and mounted in pairs on the rigid duct.

Further advantageously, the shutters which can be folded back are automatically controlled. This means that when a duct is not connected to a connection, the shutter is in the closed position and, in particular, does not permit air to escape from the duct. When a flexible duct is placed in position on the connection, means provided on the said connection cause the shutter to fold back and enable air to enter the flexible duct, or enable the snow-air mixture coming from the flexible duct connected downstream of the production element to pass into the fixed duct.

The snow transfer installation according to the invention is much more easily manipulated than the known installations. More particularly, it makes possible the utilization of high-powered air flow generators without increasing the load of the carrying vehicles which are thus limited to the low weight the assembly of the pickup and mixture production elements. Besides this, the distance travelled by the air alone in the duct which rests on the snow enables it to be cooled down and thus avoids a partial melting of the "cold" snow, the drawback of which is the formation of a film of ice on the interior wall of the duct for the first few tens of meters of transport.

The installation according to the present invention has a particularly important application in snow removal from localities, parking areas, uncovered skating rinks, paths, etc.

The present invention will now be described with reference to the attached drawings.

BRIEF DESCRIPTION OF THE DRAWINGS

FIGS. 3*a*–3*b* are schematic views of yet another embodiment of the snow transfer installation of the present invention;

FIG. 4 is a schematic view of still another embodiment of the snow transfer installation of the present invention;

DESCRIPTION OF THE PREFERRED EMBODIMENTS

Figure 1:
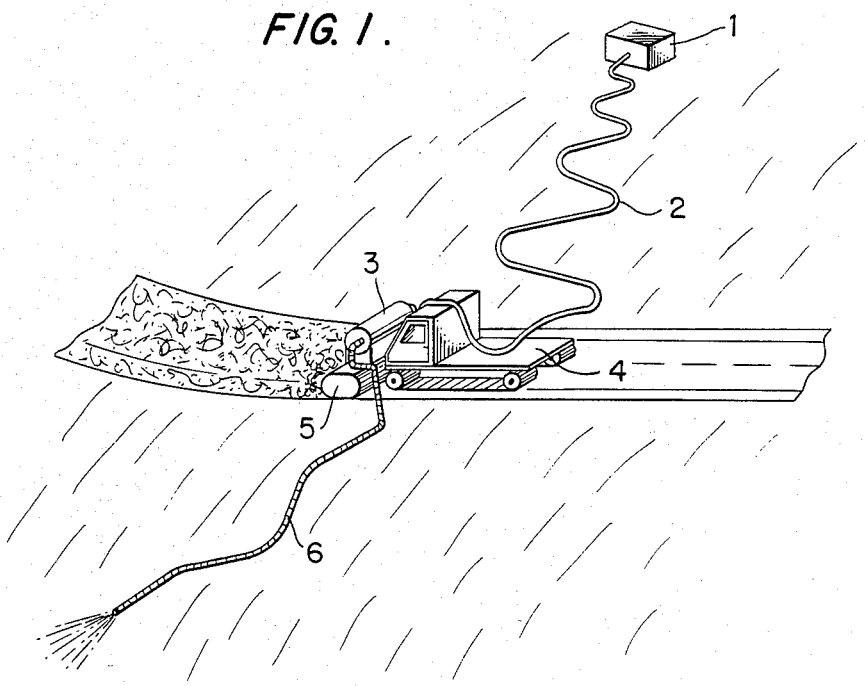
FIG. 1 is a schematic view of one embodiment of the snow transfer installation of the present invention.

FIG. 1 shows a schematic view of a snow transfer installation made according to the present invention comprising a fixed air flow generator (1), a flexible duct (2) for air supply to the production element (3) mounted on a vehicle (4) and furthermore comprising a pickup element (5) and a transportation duct (6) for the snow-air mixture to a discharge area or a ski slope.

Figure 2:
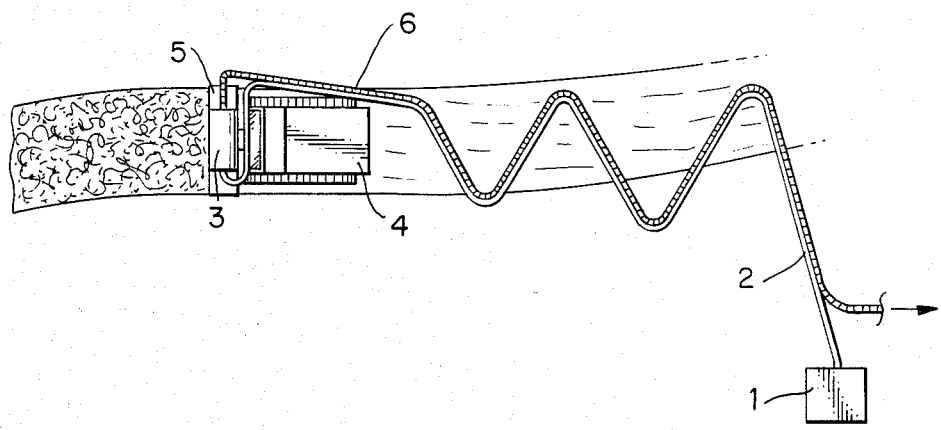
FIG. 2 is a schematic view of another embodiment of the snow transfer installation of the present invention.

In the embodiment shown in FIG. 2 it will be noted that the flexible air supply duct (2) is made integral with a flexible portion of the transportation duct (6). In this view there is shown snow removal from a path, the air flow generator (1) being mounted on a support which is displaceable independently of the vehicle (4).

In the embodiment shown in FIG. 3, the transportation duct (6) has two portions, one portion (6*a*) integral with the air supply duct (2) connected to the air flow generator (1) via the connection (14), and one portion (6*b*) with one end made integral with the framework of the air flow generator (1) and comprising a connection (15), the other end being near a discharge. In this Figure there will be noted a second air flow generator (1') to which can be connected, on the one hand, the end of the duct for air supply (2) to the connection (14') and, on the other hand, the end of the portion (6*a*) of the flexible transportation duct to the portion (6*b'*) of the transportation duct via the connection (15').

In the embodiment shown in FIG. 4, the air supply duct (2) is fixed by being anchored to the ground for a large part of its length. Air takeoff connections (7*a*, 7*b*, 7*c* . . . ) enable connection of the flexible portion of the air duct (2') connected to the production element (3) mounted on the vehicle (4). The connections which are not utilized are provided with obturators.

Figure 5:
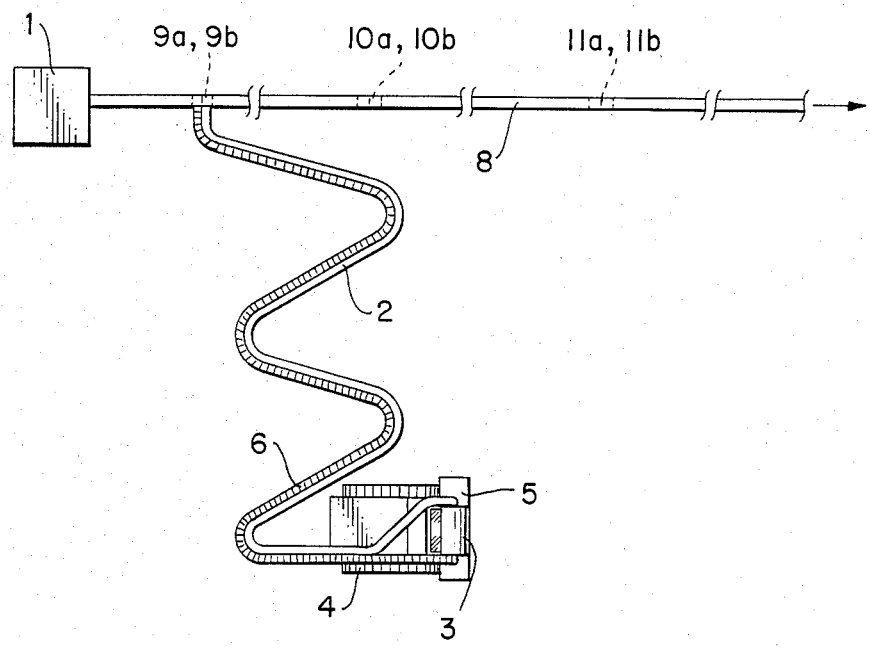
FIG. 5 is a schematic view of still another embodiment of the snow transfer installation of the present invention.

In the embodiment shown in FIG. 5, the portions of the air supply duct and the transportation duct that are fixed to the ground, utilize a common part, namely the main duct (8). On this main duct are provided pairs of connections (9*a*–9*b*, 10*a*–10*b*, 11*a*–11*b*, etc. . . .) to which there can be connected, on the one hand, the flexible portion of air supply duct (2), to the connections (a), and on the other hand, the flexible portion of the transportation duct (6), to the connections (b).

Figure 6A:
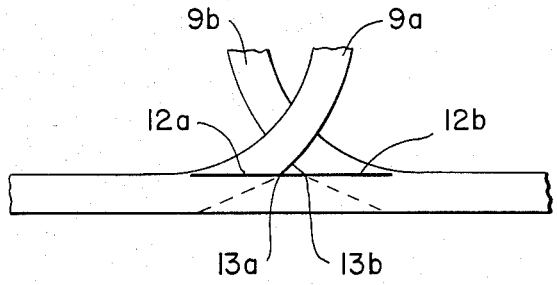
FIGS. 6A and 6B are detailed views of a portion of the snow transfer installation depicted in FIG. 5.
Figure 6B:
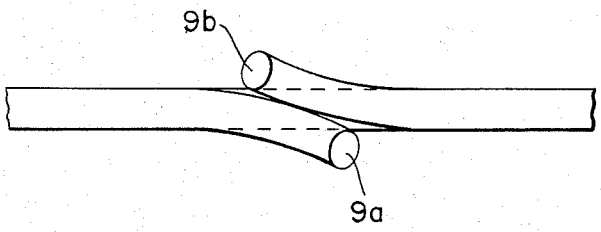

FIG. 6 shows a detailed view of a portion of the main duct (8) comprising a pair of connections (9*a*–9*b*) provided with shutters (12*a*) and (12*b*) which can be folded back about their respective axes (13*a*, 13*b*). FIG. 6*a* is a front view and FIG. 6*b* a top view. When any flexible duct is not connected to one or other of the connections (9*a*, 9*b*), one or other of the shutters (12*a*, 12*b*) is closed. If desired, only one flexible air supply duct can be connected to the connection (9*a*), the vehicle then being able to evacuate the snow-air mixture by means of a flexible duct not connected to the main duct (8). Advantageously, the connection (9*b*) is utilized at the same time as the connection (9*a*), and it can then be seen that a portion of the main duct (8) transports air and another portion transports the snow-air mixture.

The apparatus according to FIG. 5 is particularly advantageous for snow removal from surfaces such as large parking areas. The main duct (8) is then disposed along a long side of the parking area, one of its ends being connected to the air-flow generator (1) situated in a locale, the other end being situated in a drain. The ends of the flexible ducts (2) and (6) coming from the vehicle (4) are then respectively and successively connected to the pairs of connections (9*a*–9*b*), (10*a*–10*b*), (11*a*–11*b*), etc . . . to carry out snow removal from the desired portions of the surface of the parking area. In this case, it is advantageous to fix the main duct (8), not to the ground but to posts, to render it aerial.

What is claimed is:

1. Snow transfer installation comprising at least one snow pickup element; an element for the production of a mixture of snow and air, said production element being operatively connected to said pickup element; the said pickup and mixture production elements being mounted on a vehicle; a duct for transportation of the snow-air mixture operatively connected to the mixture production element; and an air flow generator, said air flow generator being independent of the pickup and mixture production elements and being connected to the mixture production element by means of an air supply duct at least one portion of which is flexible.

2. Installation according to claim 1, characterized in that the air flow generator constitutes a unit fixed with respect to the ground.

3. Installation according to claim 1, characterized in that the air flow generator constitutes a unit which is mobile independently of the vehicle carrying the pickup and production units.

4. Installation according to claim 1, characterized in that the transportation duct for the snow-air mixture is flexible over at least a fraction of its length and in that the said fraction is made integral with the flexible portion of the duct connecting the air flow generator to the production element.

5. Installation according to claim 1, characterized in that the duct connecting the air flow generator to the production element is partially rigid and in that the said rigid part is fixed to the ground.

6. Installation according to claim 1, characterized in that at least one of the respective ducts for transportation of the snow-air mixture, and for connecting the air flow generator to the production element, is provided with connectors enabling flexible ducts to be connected there.

7. Installation according to claim 6, characterized in that the said connectors are provided with shutters which can be folded back.

8. Installation according to claim 1, characterized in that the duct connecting the air flow generator to the production element is partially rigid and is provided with connectors enabling flexible ducts to be connected there.

9. Installation according to claim 8, characterized in that the said connectors are mounted in pairs on the rigid portion of the duct connecting the air flow generator to the production element.

* * * * *